United States Patent [19]

Cameron

[11] 4,061,071

[45] Dec. 6, 1977

[54] STROBOSCOPIC TUNING DEVICE FOR MUSICAL INSTRUMENTS

[75] Inventor: Tucson Cameron, San Jose, Calif.

[73] Assignee: Donald L. Cameron, Saratoga, Calif.

[21] Appl. No.: 683,768

[22] Filed: May 6, 1976

[51] Int. Cl.[2] ..... G10G 7/02

[52] U.S. Cl. ..... 84/455; 84/454

[58] Field of Search ..... 84/454, 455

[56] References Cited

U.S. PATENT DOCUMENTS

| | | | |
|---|---|---|---|
| 1,812,348 | 6/1931 | La Rue | 84/454 |
| 2,228,249 | 1/1941 | Alyn | 84/454 |
| 3,385,153 | 5/1968 | England | 84/455 |
| 3,421,402 | 1/1969 | Musser | 84/455 |
| 3,878,754 | 4/1975 | Barnum | 84/454 |
| 3,952,625 | 4/1976 | Peterson | 84/454 |

*Primary Examiner*—Stephen J. Tomsky
*Attorney, Agent, or Firm*—Jack M. Wiseman

[57] ABSTRACT

A stroboscopic tuning device for a stringed musical instrument that is mounted on the musical instrument adjacent to the strings to be tuned. A solid state circuit employs a frequency generator, such as a piezoelectric crystal oscillator or a tuning fork oscillator, to operate the stroboscopic light source at a preselected frequency. In the use of the device, a string is plucked, and when the vibratory motion of the plucked string is either the fundamental frequency or the harmonic frequency of the preselected operating frequency of the stroboscopic light source, the string will appear to an operator to be in a nonvibrating condition. At that time, the string is tuned or adjusted to the desired tone.

12 Claims, 9 Drawing Figures

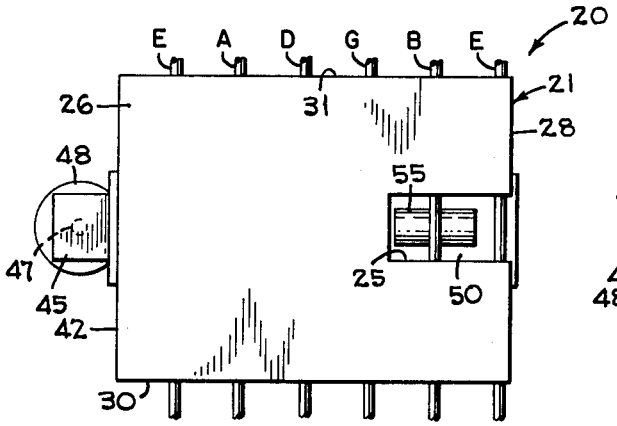
Fig-1
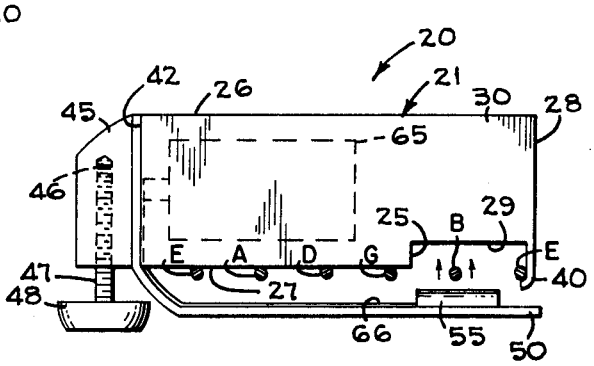
Fig-2
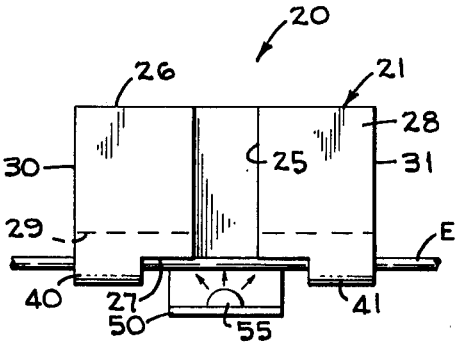
Fig-3
Fig-4
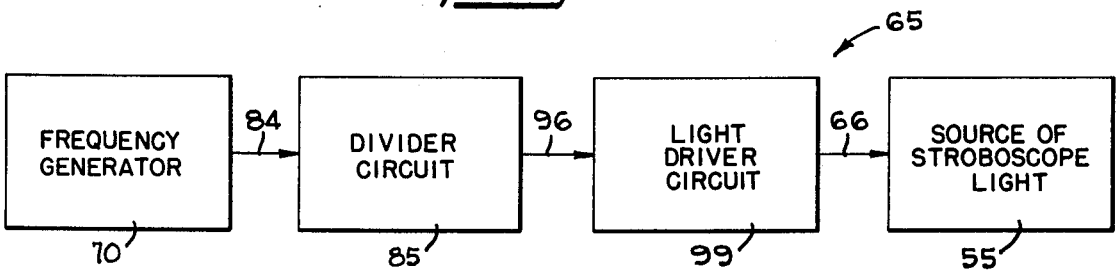

STROBOSCOPIC TUNING DEVICE FOR MUSICAL INSTRUMENTS

BACKGROUND OF THE INVENTION

The present invention relates in general to devices for tuning musical instruments and more particularly to a device for tuning stringed musical instruments.

Heretofore, tuning devices operating on the principle of sympathetic vibrations and employing tuned reeds were mounted on the stringed instrument for tuning the same. In this use of such a device, the string on the instrument was plucked and the vibration of the tuning reed was observed. Such a device has been sold by Ed Sale Guitar Co. of Avon By The Sea, N.J., as the "Vu-Pitch" visual tuner. A visual tuner for a stringed instrument employing a tuned reed and mounted on the stringed instrument was disclosed in the U.S. Pat. to Musser, No. 3,421,402 issued on Jan. 14, 1969, for Visual Tuner.

A solid state tuner has been sold by Continental Music, a division of C. G. Conn Ltd., as the "Strobotuner". The "Strobotuner", however, employed an indicator for showing the tuning condition and used a microphone to pick up the frequency of a plucked string.

In the U.S. Pat. to England, No. 3,385,153, issued on May 28, 1968, for Method Of Tuning Musical Instruments, a stroboscopic light source is spaced from the instrument to be tuned and is disposed in alignment to the string of the musical instrument to be adjusted. The patent to England disclosed the employment of specially located frets to adjust to the rate of the frame speed of a television receiver.

The U.S. Pat. to Shrady, No. 3,566,601, issued on Mar. 2, 1971, for a Crystal Oscillator Watch, discloses a piezoelectric crystal oscillator, the output of which is reduced by a dividing circuit. The output of the dividing circuit is connected to a drive circuit. A time-indicating device is operated by the drive circuit. In the U.S. Pat. to Berlincourt, No. 3,764,848, issued on Oct. 9, 1973, for Piezoelectric Starter And Ballast For Gaseous Discharge Layers, a piezoelectric oscillator starts and operates a lamp.

In the U.S. Pat. to M. Hetzel, No. 2,971,323, issued Feb. 14, 1961, for an Electronically-Controlled Timepiece, and in the U.S. Pat. to Stendel, No. 3,743,960, issued on July 3, 1973, for Circuit For Driving Frequency Standard Such As A Tuning Fork, a tuning fork is excited by electronic circuits and transistorized electronic circuits.

SUMMARY OF THE INVENTION

A stroboscopic tuning device for a stringed musical instrument that is supported by the musical instrument.

A stroboscopic tuning device for a stringed instrument which employs a circuit including an oscillator to operate a stroboscopic light at a precise frequency.

A stroboscopic tuning device for a stringed instrument which employs a frequency generator for exciting a circuit to operate a stroboscopic light at a precise frequency.

A feature of the present invention is to provide a stroboscopic tuning device which is supported by a stringed instrument along the strings to be tuned. When the resonating frequency of a plucked string is equal to the frequency of the stroboscopic flicker or any harmonic thereof, the string appears to an observer to be stationary or in a nonvibrating state. When this occurs, the string so plucked is tuned to the stroboscopic frequency or an harmonic thereof. Each string of a stringed instrument is generally desirably tuned either to the fundamental frequency or to a different harmonic of the fundamental frequency.

An object of the present invention is to provide a tuning device for tuning a stringed instrument that is accurate and durable and yet is economical to manufacture.

Another object of the present invention is to provide a tuning device for tuning a stringed instrument that is simple to use and also that is a visual-type tuner.

DESCRIPTION OF THE DRAWINGS

FIG. 1 is a plan view of a stroboscopic tuning device for a stringed instrument embodying the present invention illustrated supported by the strings of a stringed instrument.

FIG. 2 is a front elevation view of the stroboscopic tuning device shown in FIG. 1 illustrated mounted on the strings of a stringed instrument.

FIG. 3 is a side elevation view of the stroboscopic tuning device shown in FIGS. 1 and 2 illustrated mounted on the strings of a stringed instrument.

FIG. 4 is a block diagram of an electrical circuit incorporated in the stroboscopic tuning device of the present invention.

DESCRIPTION OF THE PREFERRED EMBODIMENTS

Figure 5:
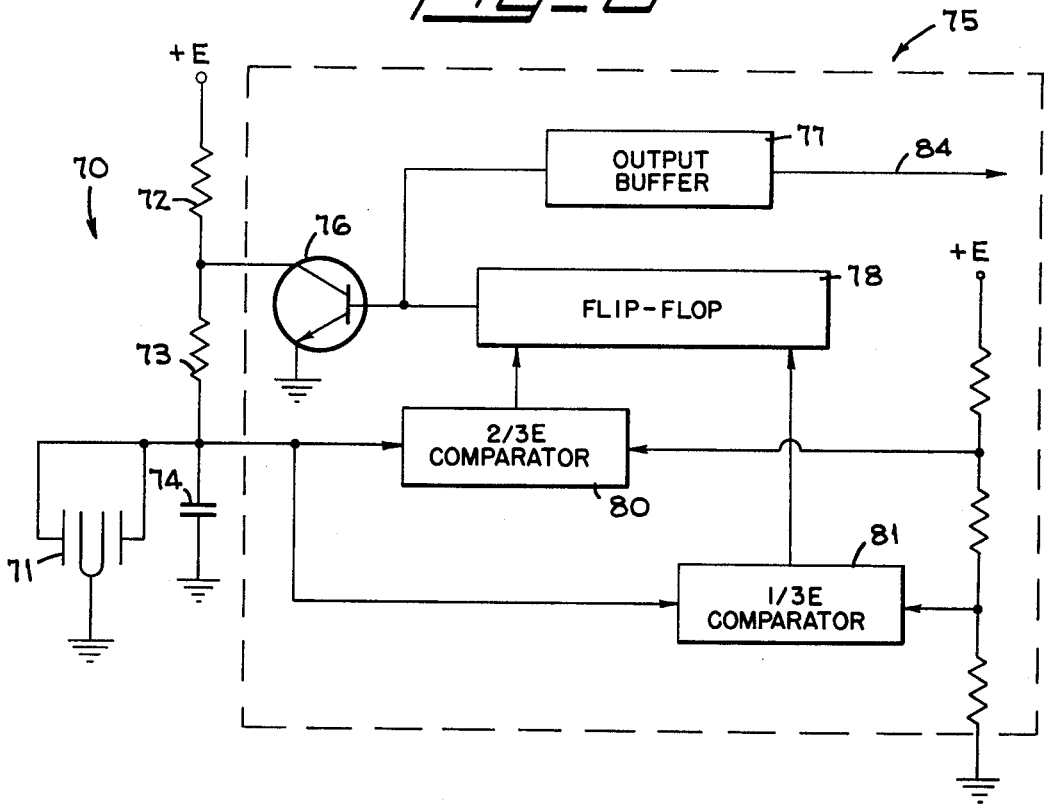
FIG. 5 is a schematic and block diagram of a tuning fork piezoelectric oscillator employed in the electrical circuit illustrated in FIG. 4.

Illustrated in FIGS. 1–3 is a stroboscopic tuning device 20 for a stringed musical instrument, which comprises a housing 21 having substantially a rectanguloid configuration and made of suitable material, such as plastic. Formed in the housing 21 is a slotted opening 25 which extends from a top wall 26 of the housing 21 through a bottom wall 27 of the housing 21. The slotted opening 25 also extends through an end wall 28 of the housing 21. Formed in the bottom wall 27 is a recess 29, which extends into side walls 30 and 31 of the housing 21.

In the exemplary embodiment of the present invention, the stringed musical instrument includes a plurality of strings E, A, D, G, B and E. As illustrated, the string B is the one under test and is observable through the slot 25. Thus, the bottom wall 32 of the housing 21 rests on the strings E, A, D and G. Fixed to the housing 21 along the end wall 28 are spaced string-engaging members 40 and 41, which serve to stabilize the housing 21 through engagement with a string, such as the illustrated string E. When it is desired to have the string G, for example, under test, then the string G would be observed through the slot 25 and the string-engaging members 40 and 41 would engage the string B. To test the strings, such as E and A, for example, it is apparent that the housing 21 can be supported by the musical instrument in an opposite transverse direction.

Projecting from a side wall 42 of the body 21 is a suitable leg 45 formed with a threaded opening 46 therein. Received by the opening 46 in threaded engagement with the surrounding wall thereof is a threaded post 47 having at the free end thereof a base 48. The base 48 engages the top of the stringed instrument. Thus, by rotating the base 48 with the threaded post 47, the height of the body 21 above the top of the stringed instrument can be adjusted so that the bottom wall 27 of the body 21 rests firmly on certain strings of the musical instrument to stabilize the mounting of the body 21 on the stringed instrument.

Fixed to the side wall 42 in abutting relation with the leg 45 is a suitable lamp holder 50, which is made of suitable insulated or insulating material, such as plastic. Mounted on the free end of the lamp holder 50 is a suitable stroboscopic light source 55, such as a neon light, light emitting diode, a gas discharge lamp or the like. Mounted in the body 21 is a suitable case or package containing electronic circuitry 65 for exciting the stroboscopic source of light 55 at a predetermined fundamental frequency over suitable conductors 66.

The present invention locates the source of stroboscopic light 55 below the strings or strings to be tested. Toward this end, the housing 21 may rest upon or be supported by the body of the stringed instrument with means extending therefrom to locate the stroboscopic source of light 55 below the string or strings to be tested. It is contemplated that mirrors can be employed for reflecting light from below the strings while the source of light may be physically located above the strings. Mirrors can also be employed for changing the viewing angle of the strings.

In the preferred embodiment of the present invention, the circuit 65 comprises a frequency generator 70, which is a piezoelectric tuning fork or bar oscillator (FIG. 5). It is to be understood that well-known and conventional precision-tuned oscillators can be employed, such as piezoelectric crystal oscillators and an R-C tuned oscillator.

The piezoelectric tuning fork oscillator 70 comprises a piezoelectric tuning fork 71 (FIG. 5) of the type sold by Seiko Instruments, Inc. of Torrance, Calif., as Type SL-NST 660. The tuning fork or bar 71 serves as a resonator. The mechanical vibrations of the tuning fork or bar 71 are coupled for electromechanical conversion through an R-C circuit comprising resistors 72 and 73 and capacitor 74. The R-C coupling circuit 72–74 is connected to a well-known monolithic timing circuit 75 of the type manufactured by Motorola Semiconductor of Phoenix, Arizona, as the MC 1455. The monolithic timing circuit 75 comprises a suitable transistor 76 which has its input electrode connected to the output side of the R-C coupling circuit 72–74 and which has its base electrode connected to the input sides of an output buffer 77 and a flip-flop circuit 78. Comparator circuits 80 and 81 are connected to the R-C coupling circuit 72–74 and to the flip-flop circuit 78.

The timing circuit 75 operates at a free running frequency. When the free running frequency of the timing circuit 75 is close to the natural frequency of the tuning fork or bar 71, the timing circuit 75 oscillates at the frequency of the tuning fork or bar 71 through the piezoelectric effect thereof.

The output of the frequency generator 70 is conducted over a conductor 84 to a suitable divider circuit 85. In the exemplary embodiment, the divider circuit 85 is a subharmonic slave oscillator. Other suitable dividers, such as digital electronic dividers, subharmonic oscillators and the like may be employed equally as well. It is within the contemplation of the present invention that the frequency of the frequency generator 70 may be low enough so as to obviate the need of a divider circuit.

The divider circuit 85 (FIG. 6) comprises an R-C coupling network having resistors 86 and 87 and a capacitor 88 for tuning the free running frequency. Connected to the R-C network 86–88 is an input electrode of a transistor 90. The base electrode of the transistor 90 is connected to the output side of a flip-flop circuit 91 and a load 92. Comparator circuits 93 and 94 are connected at the input sides thereof to the R-C network 86–88 and at the output sides thereof to the flip-flop circuit 91. Connected to another input side of the comparator circuits 93 and 94 is a suitable master oscillator signal coupling diode 95.

Figure 6:
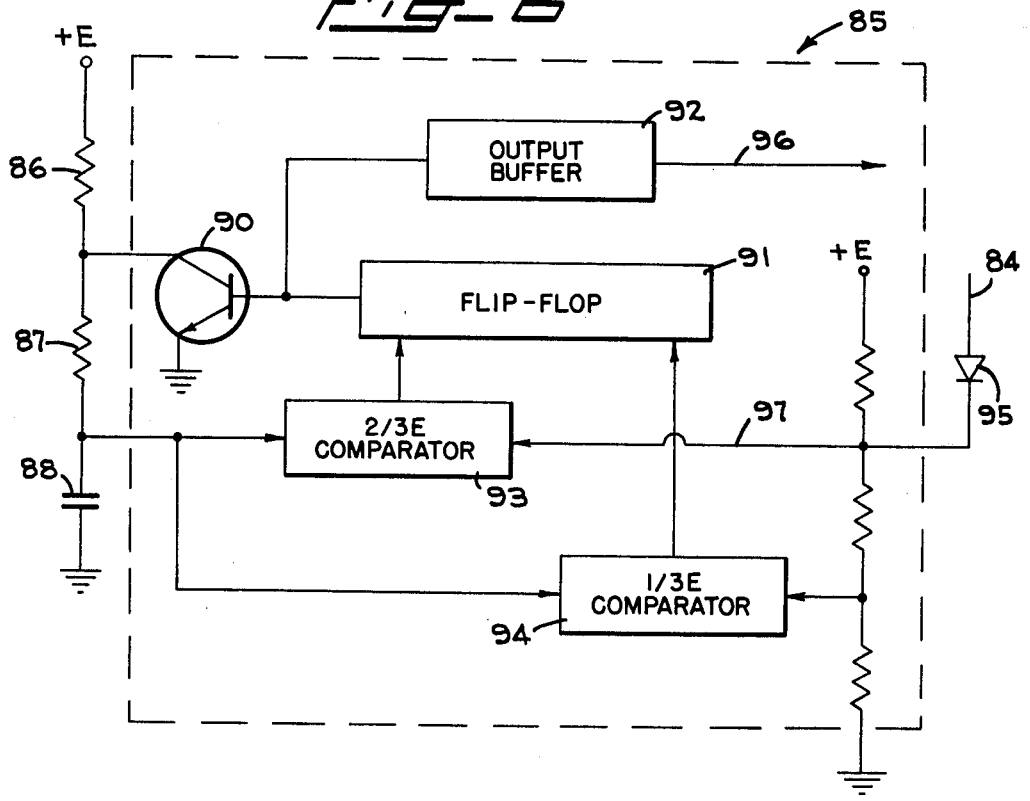
FIG. 6 is a schematic and block diagram of a subharmonic slave oscillator employed in the electrical circuit illustrated in FIG. 4.

The free running frequency oscillations tuned by the R-C circuit 86–88 in FIG. 6 is higher than a subharmonic frequency of the fundamental frequency of the generator 70. This frequency is lowered when a diode 95 conducts, causing the comparator circuit 93 input level over a conductor 97 to be raised from voltage 2/3E to voltage E. This action causes the free running frequency fed to an output buffer 92 to be reduced below the subharmonic frequency of the fundamental frequency of the generator 70. The frequency applied to the output buffer 92 is locked to the subharmonic frequency of the fundamental frequency of the generator 70 before the end of a cycle because the voltage 2/3E input signal applied to the comparator 93 is exceeded when the diode 95 stops conducting. The diode 95 stops conducting when the voltage over conductor 84 is 2/3E and starts conducting when the voltage over conductor 84 exceeds 2/3E.

Figure 7:
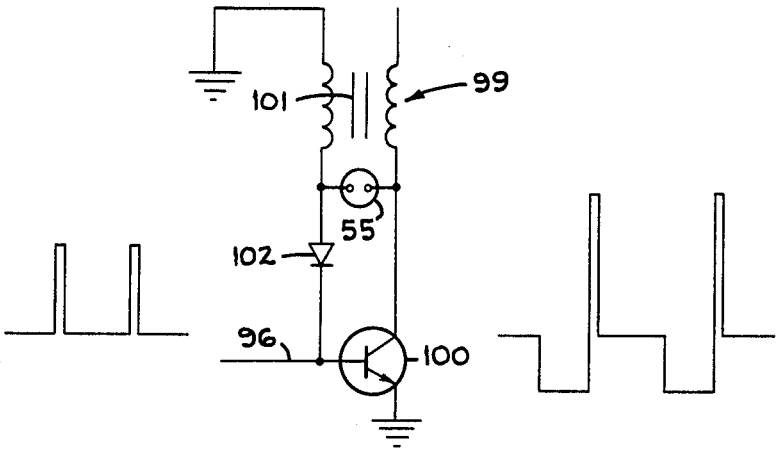
FIG. 7 is a schematic diagram of a drive circuit employed in the electrical circuit illustrated in FIG. 4.

The output of the divider circuit 85 is fed to a suitable light driver circuit 99 over the conductor 96. Suitable light divider circuits are well-known triggered blocking oscillator circuit (FIG. 7), inductive discharge circuit (FIG. 8) and a transistor direct drive circuit (FIG. 9). The blocking oscillator 99 (FIG. 7) comprises a transistor 100, the base of which has the output of the divider circuit 85 applied thereto over the conductor 96. The emitter electrode of the transistor 100 is at ground and the collector electrode of the transistor 100 has voltage E applied thereto through a transformer 101 which provides a regenerative feedback to the base electrode through a dc blocking diode 102. The source of stroboscopic light 55 in the preferred embodiment is a neon light, which is excited by the output of the transistor 100.

Figure 8:
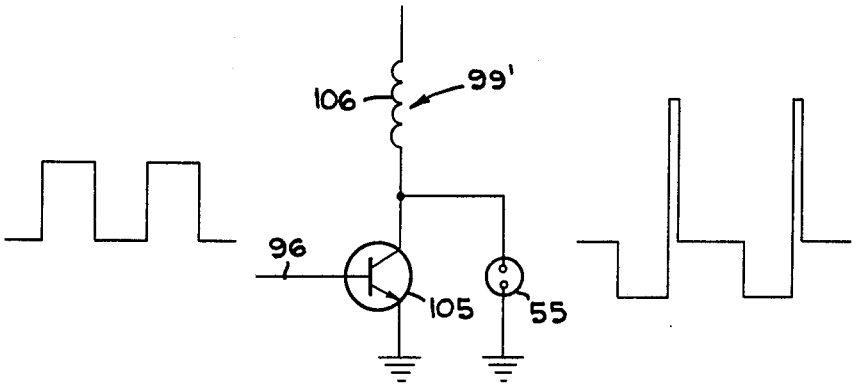
FIG. 8 is a schematic diagram of a modification of the drive circuit shown in FIG. 7.
Figure 9:
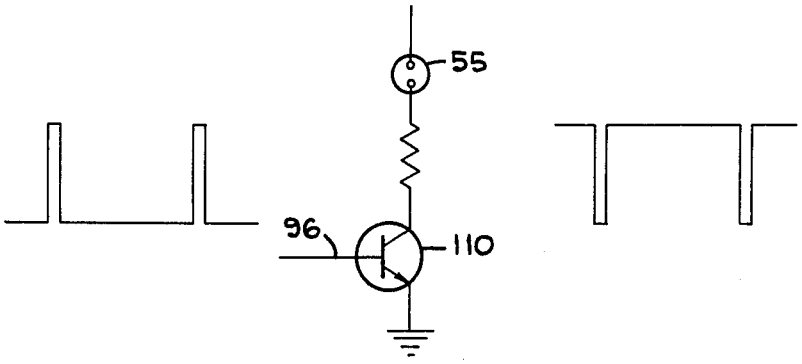
FIG. 9 is a schematic diagram of a further modification of the drive circuit shown in FIG. 7.

A modification of the drive circuit 99 is shown in FIG. 8 in the form of inductive discharge circuit 99'. The inductive discharge circuit 99' includes a transistor 105 having the output of the divider circuit applied to the base thereof over the conductor 96. The emitter electrode of the transistor 105 is at ground and the collector electrode of the transistor 100 has the voltage E applied thereto through an inductor 106. The source of stroboscopic light 55, in the form of a neon light, is connected to the collector electrode of the transistor 105 to be excited by the output thereof.

A further modification of the drive circuit 99 is shown in FIG. 9 as a transistor direct drive circuit which comprises a transistor 110. The base electrode of the transistor has the output signal from the voltage divider circuit 85 applied thereto over the conductor 96. The emitter electrode of the transistor 110 is at ground and the collector electrode of the transistor 110 has the source of stroboscopic light, such as the neon light 55, connected thereto as the load. The source of stroboscopic light 55 is excited by the output of the transistor 110.

On a conventional guitar there are six strings, namely: E, A, D, G, B and E. The desired frequencies for the strings E, A, D, G, B and E, respectively, are 82.5 cps, 110 cps, 146.666 cps, 195.555 cps, 247.5 cps, and 330 cps. In the preferred embodiment of the present invention, the source of stroboscopic light 55 flickers at a frequency of 27.5 cps. The desired frequencies of the strings E, A, B and E are harmonics of the stroboscopic frequency of 27.5 cps. Each string is tuned individually. A string under test is activated, the vibratory action appears stationary or nonvibratory against the stroboscopic light source 55 when the string is properly tuned or adjusted to the desired frequency. The D and G strings are tuned by fretting to the E and A strings respectively. Thus, only a single stroboscopic frequency is required. However, means for tuning to various frequencies is within the purview of the present invention.

I claim:

1. A tuning device for a stringed instrument comprising:

a. a source of stroboscopic light;

b. means adapted to be supported by the stringed instrument in juxtaposed relation with the strings of said stringed instrument, said source of stroboscopic light being mounted on said means for supporting said source of stroboscopic light adjacent the strings of the stringed instrument; and c. circuit means connected to said source of stroboscopic light for exciting said stroboscopic light at a preselected frequency.

2. A tuning device as claimed in claim 1 wherein said means comprises a housing and said circuit means being disposed in said housing.

3. A tuning device as claimed in claim 2 wherein said means includes a member supported by said housing and on which said source of stroboscopic light is mounted to be disposed below the strings of the stringed instrument and said housing is disposed above the strings of the stringed instrument in contact with strings of the stringed instrument to be supported thereby and said housing being formed to be in spaced relation with at least one of said strings of the stringed instrument and said housing being formed with an opening therein through which at least said one string is observable.

4. A tuning device as claimed in claim 1 wherein said means includes a member supported by said housing and on which said source of stroboscopic light is mounted to be disposed below the strings of the stringed instrument and said housing is disposed above the strings of the stringed instrument in contact with strings of the stringed instrument to be supported thereby and said housing being formed to be in spaced relation with at least one of the strings of the stringed instrument and said housing being formed with an opening through which at least said one string is observable.

5. A tuning device as claimed in claim 1 wherein said circuit comprises a frequency generator for exciting said source of stroboscopic light at the preselected frequency.

6. A tuning device as claimed in claim 5 wherein said frequency generator is a piezoelectric oscillator.

7. A tuning device as claimed in claim 5 wherein said circuit comprises a light driver circuit for operating said source of stroboscopic light in response to excitation by said frequency generator.

8. A tuning device as claimed in claim 7 wherein said circuit comprises a divider circuit connected to the output of said frequency generator and the input of said light driver circuit.

9. A tuning device as claimed in claim 3 and comprising a string-engaging member on said housing for engaging a string of the stringed instrument other than said one string for stabilizing said housing.

10. A tuning device as claimed in claim 4 and comprising a string-engaging member on said housing for engaging a string of the stringed instrument other than said one string for stabilizing said housing.

11. A tuning device as claimed in claim 2 wherein said means includes a member supported by said housing and on which said source of stroboscopic light is mounted to be disposed below the strings of the stringed instrument.

12. A tuning device as claimed in claim 1 wherein said means includes a member supported by said housing and on which said source of stroboscopic light is mounted to be disposed below the strings of the stringed instrument.

* * * * *